United States Patent [19]

Cassagnes

[11] 4,251,920

[45] Feb. 24, 1981

[54] DRAWING APPARATUS

[76] Inventor: Andre J. M. Cassagnes, 66 Avenue Andre Maginot, Vitry sur Seine 9440, France

[21] Appl. No.: 43,361

[22] Filed: May 29, 1979

[30] Foreign Application Priority Data

Sep. 4, 1978 [FR] France ..... 78 25386

[51] Int. Cl.[3] ..... B44D 3/30

[52] U.S. Cl. ..... 33/174 B; 33/174 G

[58] Field of Search ..... 33/174 B, 174 G

[56] References Cited

U.S. PATENT DOCUMENTS

| | | | |
|---|---|---|---|
| 2,950,537 | 8/1960 | Fixen | 33/174 B |
| 3,568,327 | 3/1971 | Furuoka | 33/174 B |
| 3,633,286 | 1/1972 | Maurer | 33/174 B |
| 3,900,956 | 8/1975 | Furuoka et al. | 33/174 B |

FOREIGN PATENT DOCUMENTS

| | | | |
|---|---|---|---|
| 1917838 | 11/1969 | Fed. Rep. of Germany | 33/174 B |

*Primary Examiner*—Willis Little

*Attorney, Agent, or Firm*—Salter & Michaelson

[57] ABSTRACT

Drawing apparatus comprising a fixed but interchangeable stencil provided with a cut-out having a definite shape serving as a guide for a drawing member, and a support for receiving the inscriptions of the drawing member, said support being rotatable so as to be able to be moved rotatably in increments through successive stages.

10 Claims, 7 Drawing Figures

FIG. 5
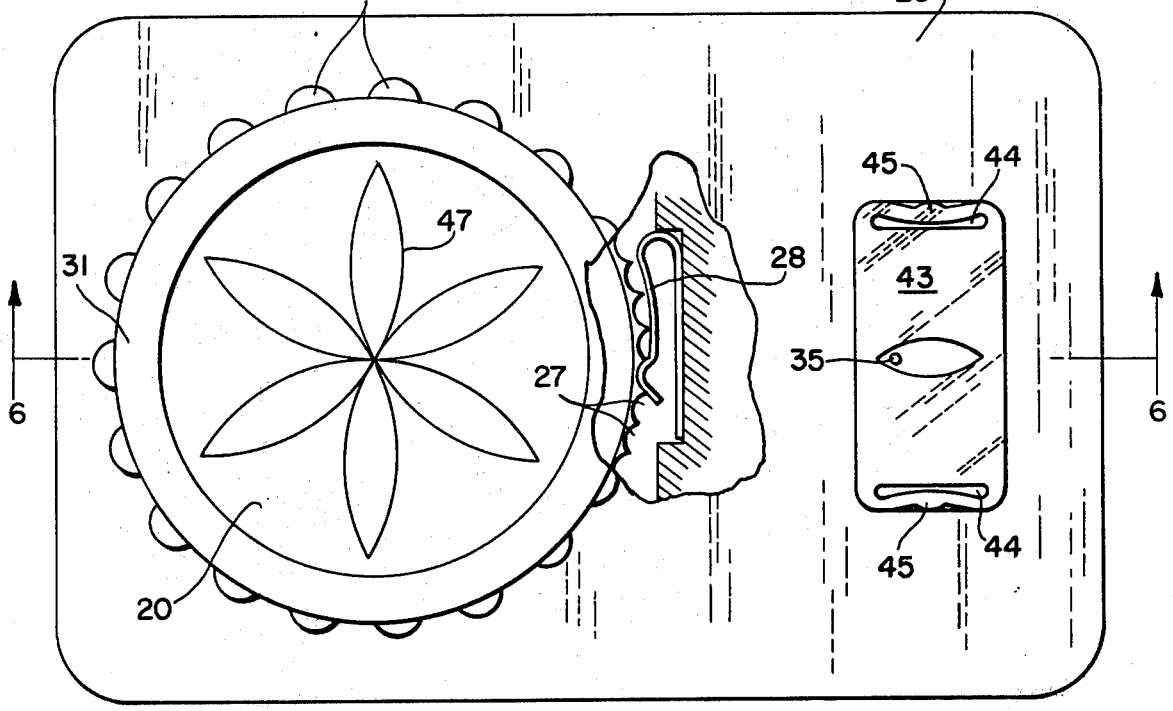
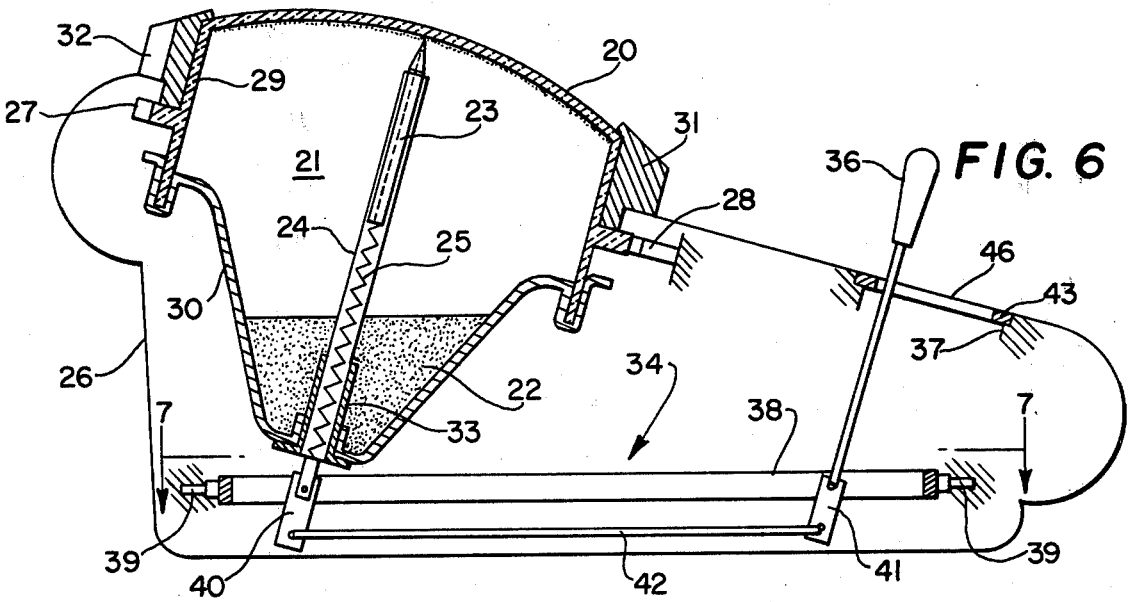
FIG. 6
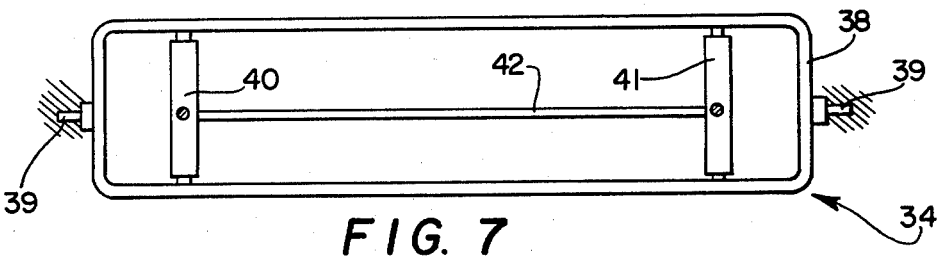
FIG. 7

DRAWING APPARATUS

The present invention concerns a drawing device, intended particularly for children and enabling them to produce in a simple and amusing way all sorts of figures having an essentially geometrical base.

To this end, the apparatus of this invention essentially comprises, in combination, a fixed but interchangeable stencil provided with a cut-out having a definite shape serving as a guide for a drawing member, and a support adapted to receive the inscriptions of the drawing member, this support being rotatably mounted so as to be able to be moved rotatably in successive stages.

With this arrangement, as will be seen more clearly later on, it is possible to very easily produce fairly complicated figures from one or more stencils having cut-outs of a simple shape.

According to a first embodiment of the invention, the support for receiving the inscriptions of the drawing member is removably fixed on a rotating plate carried on a rigid stand, while the interchangeable stencil is mounted on this stand in an aperture forming a socket or receptacle disposed directly above said plate.

Preferably, the stand is formed of two parts hinged to each other, carrying respectively the rotating plate and the pocket for the stencil, so as to facilitate access to said plate and thus allow replacement of the used support.

To this end, the support, formed, for example, by a simple sheet of paper, is removably fixed on the plate, having a circular shape, by means of a perforated disc engaging on the edges of said plate.

Preferably also, the plate is provided on its periphery with evenly spaced notches cooperating with a fixed resilient bearing member.

It is thus possible to rotate the plate exactly the amount desired by simply moving it by hand from one notch to the next.

According to a second embodiment of the invention, the support for receiving the inscriptions of the drawing member is formed in a known way, i.e. by a translucent screen forming the upper part of a sealed enclosure containing a powdery material capable of sticking to the inner face of said translucent screen, whereas the drawing member is formed by a movable pen disposed inside said enclosure and bearing resiliently on the inner face of the screen. U.S. Pat. No. 3,055,113 is an example of such an arrangement.

The use of this well known technique also allows all sorts of patterns to be produced easily, but it is obviously not possible in this case to permanently conserve said patterns since they must be progressively wiped out.

In a particular embodiment, the screen is provided having a circular and bulging shape, while the drawing pen passes axially across the bottom of the enclosure, in a sealed and hinged way, one end of the drawing pen being connected by means of a suitable linkage to a control member of the "joystick" type movable along the periphery of the cut-out of the stencil.

Preferably, the sealed enclosure and the linkage are disposed in the same hollow case in which there is also provided an aperture through which the control member passes and a receiving pocket or receptacle for the interchangeable stencil.

Preferably also, the sealed enclosure is rotatably mounted on the case and comprises on its periphery, as in the first embodiment, evenly spaced notches cooperating with a resilient bearing member integral with the case.

As for the stencil, it is advantageously formed by a small plastic material plate whose outer form corresponds to that of the receiving pocket provided about the aperture, this small plate comprising, in addition to the cut-out for guiding the drawing member, at least one longitudinal slit disposed close to one of its edges and a boss projecting from this edge, so as to allow the stencil to be forced into the pocket owing to the resilient distortion of said edge of the small plate.

Several embodiments of the invention are described hereafter by way of examples with reference to the accompanying drawings in which:

FIG. 5 is a plan view of a variation of the present invention;

FIG. 6 is a sectional view along line VI-VI of FIG. 5; and

FIG. 7 is a partial sectional view along line VII-VII of FIG. 6.

Figure 2:
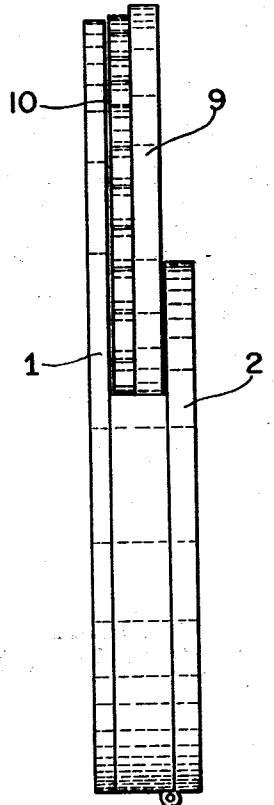
FIG. 2 is a side view of this apparatus.
Figure 1:
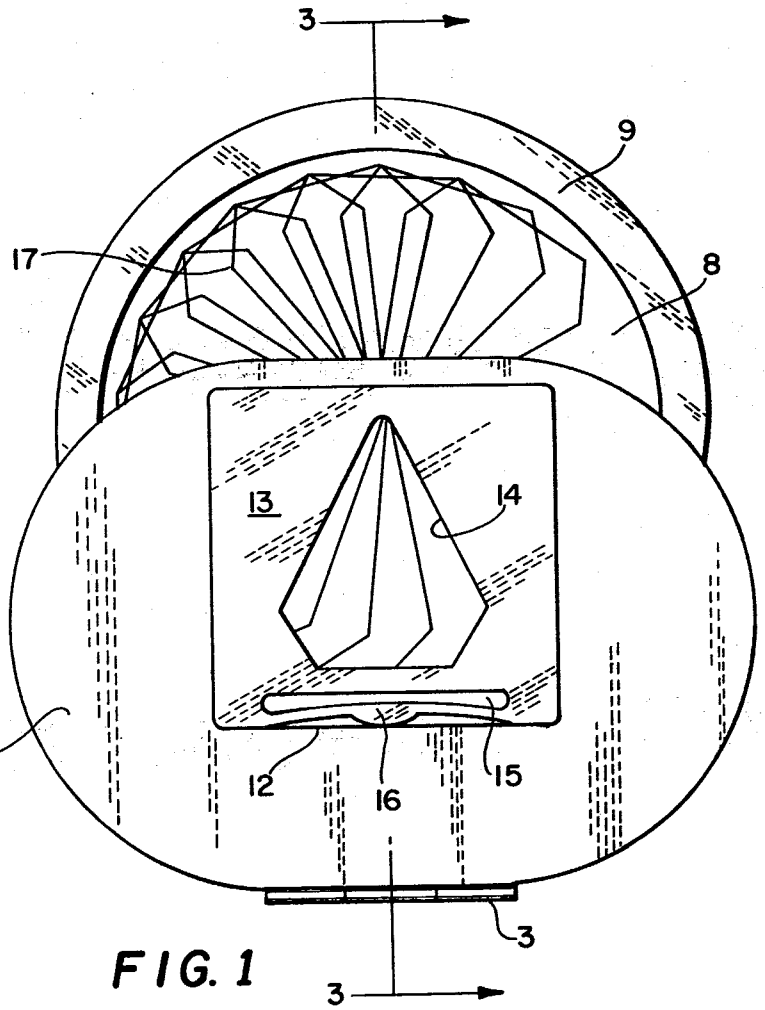
FIG. 1 is a plan view of a first embodiment of the drawing apparatus of the invnetion.
Figure 3:
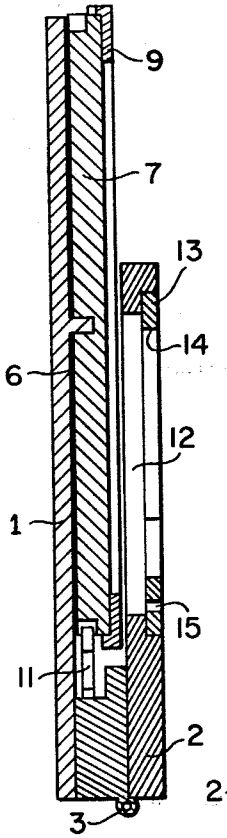
FIG. 3 is a sectional view along line III-III of FIG. 1.
Figure 4:
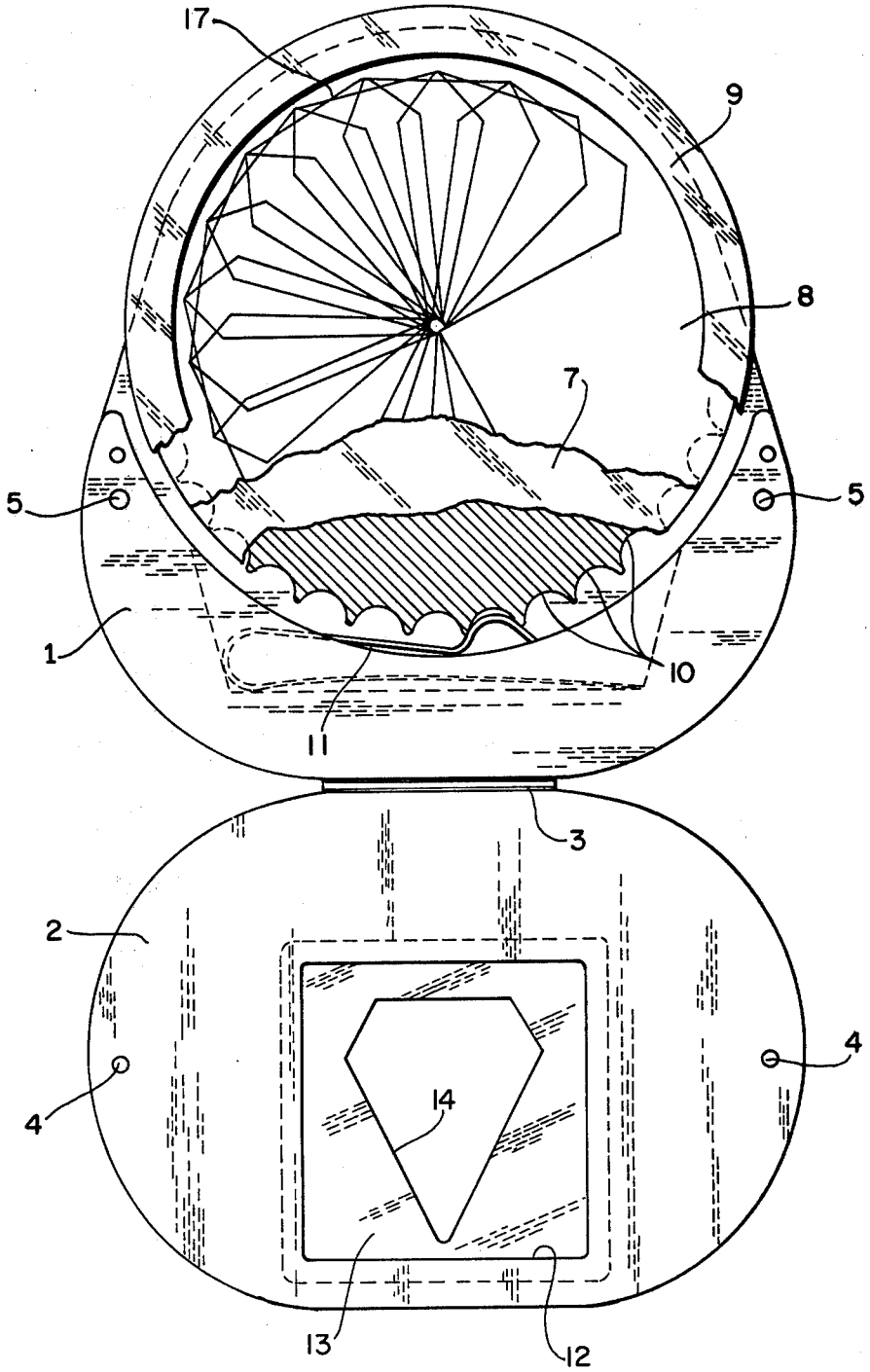
FIG. 4 is a plan view of the same apparatus, but shown in open position.

Referring first of all to FIGS. 1 to 4, it can be seen that the drawing apparatus of the invention is composed essentially of a stand in two parts 1 and 2 which are hinged one to the other by means of a hinge 3. Stand part 1 forms in fact the base of the apparatus, whereas the other stand part forms a sort of lid which may be either open, as shown in FIG. 4, or folded back against base 1, as shown in FIG. 1. In this latter position, the two parts of the stand are accurately aligned to one another by means of two pegs 4 provided on lid 2 and cooperating with two bores 5 provided in base 1.

On base 1 there is rotatably mounted about a pin 6 a circular plate 7 on which is removably fixed a support 8 adapted to receive the inscriptions, for example, a simple sheet of paper or cardboard. This support, whose shape and dimensions correspond to those of plate 7, is held in place on the latter by means of a circularly perforated disc 9 which is designed to be a force-fit on the edge of the plate, while allowing the major part of the surface of the support to be visible. It is thus possible to very easily replace the used support with a new one, assuming of course, that the lid 2 is first raised, as shown in FIG. 4.

Circular plate 7 is furthermore provided on its lower periphery with a series of regularly spaced notches 10, into which bears a fixed resilient member, such as a simple blade spring 11. It will be readily understood that with such an arrangement plate 7 with its support 8 may be easily turned by hand in any direction through an accurate angle, determined each time by the number of successive notches past which the blade spring 11 travels, this for a reason which will appear more clearly hereafter.

In cover 2 there is provided an aperture or window 12, which, when this lid is brought down on base 1, i.e. as shown in FIG. 1, is situated above a portion of the visible surface of support 8. Moreover, this surface portion covered by aperture 12 should preferably be offcenter with respect to support 8. In the present case, said aperture is square in shape and extends substantially over the lower half of support 8.

In accordance with the invention, aperture 12 is adapted to receive an interchangeable stencil 13 provided with a cut-out 14 of a particular shape whose profile is capable of serving as a guide for any kind of drawing member, such as a pencil or a ball-point pen. To this end, aperture 12 is provided with a peripheral shoulder forming a receiving pocket for stencil 13 whose outer contour is also square.

In the particular example described and shown, stencil 13 is formed by a simple small plastic material plate comprising, in addition to cut-out 14 which has here a vaguely triangular shape, a longitudinal slit 15 disposed close to one of its edges, as well as a boss 16 projecting from said edge. Thus, as FIG. 1 clearly shows, stencil 13 may be force-fitted into the housing formed by the peripheral shoulder of aperture 12, owing to resilient deformation of the edge made thinner by slit 15. It is then, in this way, firmly held in place and may nevertheless be very easily withdrawn to be replaced by another stencil of the same type, but having a cut-out 14 of a different shape.

The drawing apparatus according to the invention which has just been described is used in the following way:

With stencil 13 in position in aperture 12 and with lid 2 brought down against base 1 of the stand, i.e. in the position shown in FIG. 1, we begin by drawing on support 8 a closed figure corresponding to the profile of cut-out 14 of the stencil by means of a suitable writing instrument, for example a ball-point pen. To do this, we naturally rest the pen against the profile of cut-out 14 which then serves as a guide, as in an ordinary stencil.

When this first figure has been produced, we turn by hand, in one or the other direction, plate 7 carrying support 8 through a definite number of notches, for example two. Then we draw on support 8 a new identical figure, still using stencil 13 to guide the pen.

We then continue in the same way, taking great care to turn plate 7 always in the same direction and through the same number of notches, until support 8 has turned a complete revolution. This results is a geometrical pattern of the rose window type, such as the one shown at 17 is FIGS. 1 and 4.

The pattern obtained may then be further enhanced by means of other stencils having cut-outs of different shapes, or support 8 may be replaced so as to produce an entirely new pattern.

The apparatus of the invention permits, in short, all sorts of geometrical patterns of the rose window kind to be produced very easily, and this from only a few different stencils. In fact, the number of possible combinations is practically infinite.

We can first of all vary the number of notches which determines the angle of rotation of the support 8 between each operation. It is obviously preferble for the total number of notches provided in plate 7 to be a whole multiple of this number, so that the pattern may close on itself, but this is not absolutely indispensable. With this in mind, the plate will advantageously be provided with 60 notches, a number divisible particularly by 2, 3, 4, 5, and 6.

Several different stencils may naturally then be combined in the same pattern. Moreover, since the stencils have here a square outer shape, each of them may be used in different directions, which further enhances the possibilities.

It is further evident that the patterns thus produced lend themselves particularly well to coloring, which forms an additional attraction for children, all the more so since said patterns may be kept for subsequent use, such as, for example, decorations or the like.

On the other hand, in the embodiment of the invention which is shown in FIGS. 5 to 7, use is made of an inscription technique well known in other connections, but in which the patterns must be wiped out progressively as they are produced and cannot then be permanently kept as in the preceding embodiment.

The support for receiving the inscriptions is here composed by a translucent screen 20 having a circular and bulging shape, which forms the upper part of a sealed enclosure 21 containing a powdery material 22, for example, aluminum powder, capable of sticking to the inner surface of screen 20. As for the drawing member, it is formed by a stylus 23 bearing resiliently against said inner surface of the screen. For this, the stylus is slidingly mounted in a support tube 24 inside of which is a pressure spring 25.

It will be readily understood that by moving stylus 23, the latter removes powder 22 sticking to the surface of screen 20 while forming a line which is then visible from the outside through the translucent wall of said screen. Furthermore, this line may be immediately wiped out, since it is only necessary that the enclosure be turned over and lightly shaken so as to cause the powder 22 to stick again in the places cleared by the stylus.

In accordance with the invention, the translucent screen 20 is rotatably mounted on a hollow case 26, made for example from a molded plastic material, and comprises also, as in the preceding embodiment, a series of notches 27 cooperating with a blade spring 28 fixedly secured to said case. Thus, as can be more clearly seen in FIG. 6, these notches 27 are disposed on the periphery of an annular skirt 29 extending around screen 20. The bottom of enclosure 21 is formed by a wall of flexible plastic material 30 fitting over the edge of skirt 29. The visible part of screen 20 is fixed furthermore into a ring 31 provided with large projections 32 which facilitate the manual rotation of the assembly in relation to case 26.

Tube 24 which houses stylus 23 passes axially through the bottom of the enclosure through a seal 33 and thus allows the stylus to be moved in all directions from the outside, owing to the flexibility of bottom wall 30. To achieve this universal movement, the end of tube 24 is connected by a suitable linkage 34 to a control member 35 of the "joystick" type, provided with a grip 36 projecting outside case 26 through an aperture 37.

Thus, as can be more clearly seen in FIG. 7, linkage 34 comprises first of all a rigid frame 38 which is rotatably mounted about a first longitudinal axis through pivots 39. On this frame are disposed two parallel transverse members 40 adn 41 which are rotatably mounted about axes perpendicular to said longitudinal axis and which are respectively interlocked with tube 24 carrying the stylus 23 and with control member 35. Said transverse members are furthermore connected by a rod 42 and thus form a deformable parallelogram. With this arrangement, all the movements made with the control member 35 are faithfully reproduced by tube 24 and so by the drawing stylus 23.

As in the preceding embodiment, the aperture or window 37 provided in case 26 comprises on one part of its periphery a shoulder forming a receiving socket for an interchangeable stencil 43 which is here rectangular in shape. This stencil is also provided with two lateral slits 44 associated with bosses 45 and allowing it to be force-fitted into said socket. It will be noted further that the stencil thus only partially covers aperture 37 and may thus be easily withdrawn by introducing a finger into the visible part of said aperture.

Stencil 43 is moreover provided with a cut-out 46 through which passes control member 35 and whose profile is adapted to serve as a guide for said control member. Because of the position of the stencil in relation to aperture 37, this cut-out 46 is naturally staggered and corresponds accordingly also to an offset part of screen 20. In the particular embodiment described here, cut-out 46 is in the shape of a biconvex lens and thus allows patterns of the kind shown at 47 in FIG. 5 to be produced on screen 20. For this, we proceed in the way already described, the only difference being that the pen is here replaced by control member 35.

We can thus see that with such an apparatus it is also possible to very easily produce all sorts of patterns. These patterns will, however, as previously stated, have to be wiped out progressively as they are produced, by simply turning the apparatus over.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A drawing apparatus comprising a stand, a stencil fixedly but interchangeably mounted on said stand, said stencil having a cut-out of a definite shape serving as a guide for a drawing member, and a suport removably mounted on said stand and disposed so as to receive the inscriptions of the drawing member, said support being rotatably mounted so as to be rotatably movable through successive stages, said stencil being mounted on said stand in an aperture forming a receptacle disposed directly above said support, said stencil comprising a flexible plate having an outer shape corresponding to the shape of said receptacle and having said cut-out for guiding the drawing member, and further having at least one longitudinal slit disposed close to one of its edges and a boss projecting from said edge, so as to allow the stencil to be frictionally forced into said receptacle owing to the resilient deformation of said edge of said plate.

2. A drawing apparatus according to claim 1, characterized in that the support for receiving the inscriptions of the drawing member is removably fixed to a rotating plate carried by said stand.

3. A drawing apparatus according to claim 2, characterized in that the stand is formed from two parts hinged to one another, carrying respectively the rotating plate and the receptacle for the stencil.

4. A drawing apparatus according to claim 2 or 3, characterized in that the support is removably fixed to the plate by means of a perforated disc engaging on the edges of said rotating plate, said support and said rotating plate both being circular.

5. A drawing apparatus according to claim 4, characterized in that the plate is provided on its periphery with evenly spaced notches cooperating with a resilient bearing member fixedly secured to said stand.

6. A drawing apparatus comprising a stand, a stencil fixedly but interchangeably mounted on said stand, said stencil having a cut-out of a definite shape serving as a guide for a drawing member, and a support removably mounted on said stand and disposed so as to receive the inscriptions of the drawing member, said support being rotatably mounted so as to be rotatably movable through successive stages, said support comprising a translucent screen forming the upper part of a sealed enclosure containing a powdery material capable of sticking to said translucent screen, said drawing member comprising a movable stylus disposed inside said enclosure and bearing resiliently on the inner face of said screen.

7. A drawing apparatus according to claim 6, characterized in that the screen is circular and bulging in shape, while the drawing stylus passes axially through the bottom of the enclosure in sealed and hinged relation, the adjacent end of which is connected by means of a suitable linkage to a control member of the "joystick" type operable to engage and follow the periphery of the cut-out of the stencil.

8. A drawing apparatus according to claim 7, characterized in that the sealed enclosure and the linkage are disposed within a hollow case in which are also provided an aperture through which the control member passes and a receptacle for the interchangeable stencil.

9. A drawing apparatus according to claim 8, characterized in that the sealed enclosure is rotatably mounted on the case and comprises on its periphery evenly spaced notches cooperating with a resilient bearing member fixedly secured to said case.

10. A drawing apparatus according to any one of claims 8 or 9, characterized in that the stencil is formed by a small plastic material plate whose outer shape corresponds to that of the receptacle provided about the aperture, said small plate comprising the cut-out for guiding the drawing member and at least one longitudinal slit disposed close to one of its edges and a boss projecting from said edge, so as to allow the stencil to be frictionally forced into said receptacle owing to the resilient deformation of said edge of said plate.

* * * * *